US009519265B2

(12) United States Patent
Tanaka

(10) Patent No.: US 9,519,265 B2
(45) Date of Patent: Dec. 13, 2016

(54) IMAGE FORMING APPARATUS INCORPORATING IMAGE FORMING DEVICE AND COOLING DEVICE THEREIN

(71) Applicant: Gakushi Tanaka, Kanagawa (JP)

(72) Inventor: Gakushi Tanaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/842,366

(22) Filed: Sep. 1, 2015

(65) Prior Publication Data

US 2016/0091859 A1 Mar. 31, 2016

(30) Foreign Application Priority Data

Sep. 26, 2014 (JP) ..... 2014-196622

(51) Int. Cl.
*G03G 21/20* (2006.01)
*G03G 15/00* (2006.01)

(52) U.S. Cl.
CPC ..... *G03G 21/206* (2013.01); *G03G 15/5012* (2013.01); *G03G 15/50* (2013.01)

(58) Field of Classification Search
CPC ..... G03G 15/50; G03G 21/20; G03G 21/206
USPC ..... 399/44, 85, 92, 94
See application file for complete search history.

(56) References Cited

U.S. PATENT DOCUMENTS

2007/0212083 A1* 9/2007 Ishikuro ..... G03G 15/2014 399/44
2009/0116859 A1* 5/2009 Mohri ..... G03G 21/20 399/43
2010/0239277 A1 9/2010 Mohri et al.

FOREIGN PATENT DOCUMENTS

| | | |
|---|---|---|
| JP | 2006-078683 | 3/2006 |
| JP | 2006-133279 | 5/2006 |
| JP | 2008-292679 | 12/2008 |
| JP | 2010-244032 | 10/2010 |

* cited by examiner

*Primary Examiner* — Benjamin Schmitt
(74) *Attorney, Agent, or Firm* — Harness, Dickey & Pierce, P.L.C.

(57) ABSTRACT

An image forming apparatus includes an apparatus body, an image forming device provided in the apparatus body and forming an image on a surface of a recording medium, a cooler to cool the image forming device, a temperature detector to detect a temperature around the apparatus body, and a controller including a computing part to count a driving period of the image forming device and a memory to store a computed value obtained by the computing part as a counter value. The controller controls driving of the image forming device and driving of the cooler based on a detected temperature obtained by the temperature detector and the counter value. The controller adjusts the driving of the image forming device irrespective of the counter value to a regular driving speed when the detected temperature is lower than a reference temperature.

19 Claims, 13 Drawing Sheets

IMAGE FORMING APPARATUS INCORPORATING IMAGE FORMING DEVICE AND COOLING DEVICE THEREIN

CROSS-REFERENCE TO RELATED APPLICATIONS

This patent application is based on and claims priority pursuant to 35 U.S.C. §119(a) to Japanese Patent Application No. 2014-196622, filed on Sep. 26, 2014, in the Japan Patent Office, the entire disclosure of which is hereby incorporated by reference herein.

BACKGROUND

1. Technical Field

This disclosure relates to an image forming apparatus including an image forming device and a cooling device.

2. Related Art

Electrophotographic image forming apparatuses form images following processes for image formation. Specifically, an electrophotographic image forming apparatus performs image formation following processes of: uniformly charging a surface of an image bearer such as a photoconductor; forming optical image data as a latent image on the previously charged surface of the image bearer; developing the latent image into a visible image by supplying toner from a developing device; transferring the visible image onto a recording medium such as a transfer paper directly or via an intermediate transfer body such as an intermediate transfer belt; and fixing the visible image to the recording medium in a fixing device.

In such an image forming apparatus, a temperature in an image forming part including the above-described image forming devices increases due to generation of heat by heat from the fixing device and/or by friction between a roller shaft and a roller bearing during a printing operation performed by the image forming devices. If the temperature in the image forming part exceeds a toner melting point, toner in the image forming part adheres. Further, a recent promotion of a reduction in size of units and components used for an image forming apparatus causes the temperature in the image forming part to increase more easily.

In order to avoid such adhesion of toner in the image forming part, an image forming apparatus includes a cooling fan to cool the inside of the image forming part.

Further, the image forming apparatus further includes a thermistor to detect a temperature of the photoconductor drum and a temperature in the vicinity of the intermediate transfer body. Such the image forming apparatus controls a speed of rotation of the cooling fan based on detection results obtained by the thermistor.

SUMMARY

At least one aspect of this disclosure provides an image forming apparatus including an apparatus body, an image forming device provided in the apparatus body and forming an image on a surface of a recording medium, a cooler to cool the image forming device, a temperature detector to detect a temperature around the apparatus body, and a controller including a computing part to count a driving period of the image forming device and a memory to store a computed value obtained by the computing part as a counter value. The controller controls driving of the image forming device and driving of the cooler based on a detected temperature obtained by the temperature detector and the counter value. The controller adjusts the driving of the image forming device irrespective of the counter value to a regular driving speed when the detected temperature is lower than a reference temperature.

DETAILED DESCRIPTION

Figure 1:
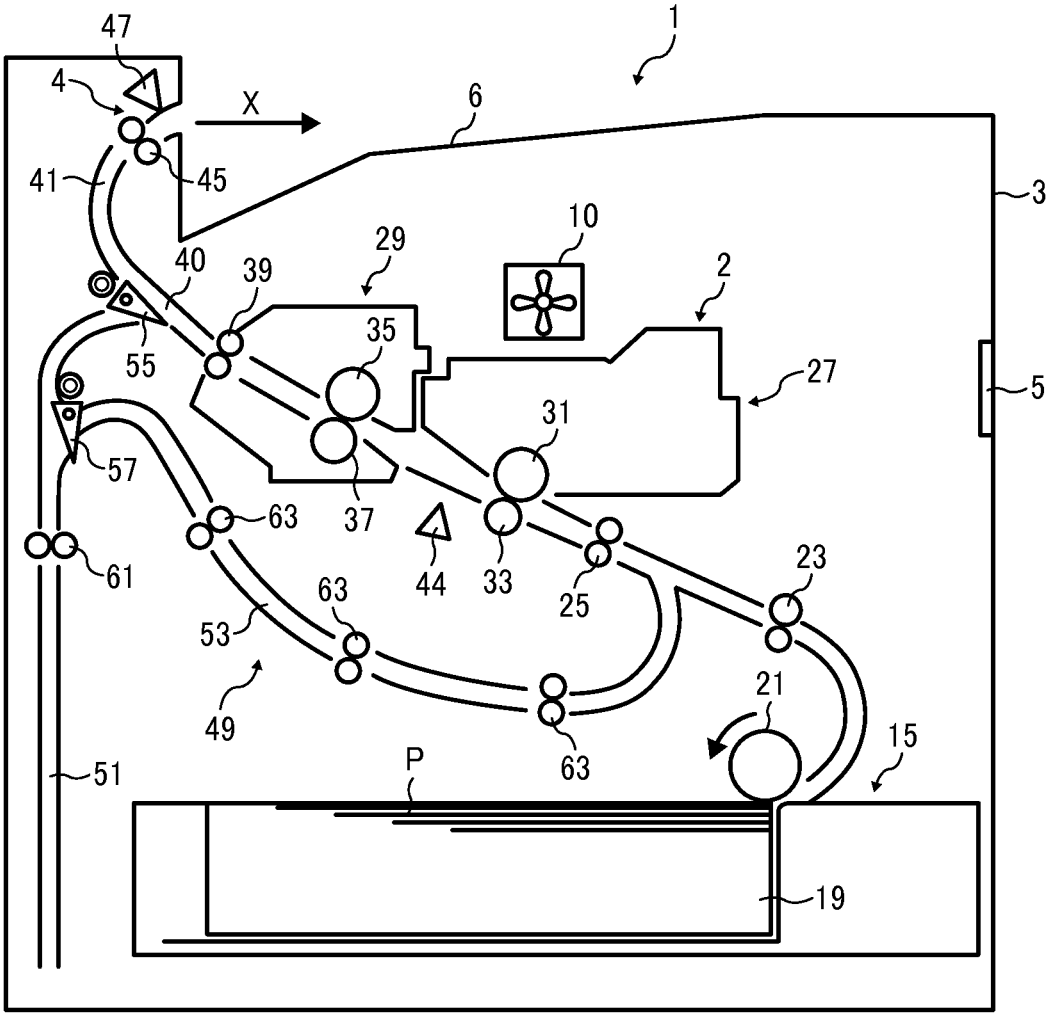
FIG. 1 is a diagram illustrating a schematic configuration of an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an image forming apparatus 1 according to an example of this disclosure with reference to drawings.

The image forming apparatus 1 may be a copier, a printer, a scanner, a facsimile machine, a plotter, and a multifunction peripheral or a multifunction printer (MFP) having at least one of copying, printing, scanning, facsimile, and plotter functions, or the like. According to the present example, the image forming apparatus 1 is an electrophotographic printer that forms toner images on a sheet or sheets by electrophotography.

Further, this disclosure is also applicable to image forming apparatuses adapted to form images through other schemes, such as known ink jet schemes, known toner projection schemes, or the like as well as to image forming apparatuses adapted to form images through electro-photographic schemes.

It is also to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, sheet member, and recording material to which the developer or ink is attracted.

Now, a description is given of the image forming apparatus 1 according to an example of this disclosure.

FIG. 1 is a diagram illustrating a schematic configuration of the image forming apparatus 1 according to an example of this disclosure.

As illustrated in FIG. 1, the image forming apparatus 1 includes an apparatus body 3, an image forming part 2, a sheet ejecting part 4, and a sheet stacker 6.

The image forming part 2 is located substantially at a center of the apparatus body 3 to form an image on a sheet that functions as a recording medium. The sheet ejecting part 4 ejects the sheet in a sheet ejecting direction X after the image is formed on the sheet in the image forming part 2. The sheet stacker 6 stacks the ejected sheet therein.

The apparatus body 3 further includes a sheet feeding part 15 in a lower part thereof and an image forming device 27 and a fixing device 29 in an upper part thereof.

The sheet feeding part 15 includes a sheet tray 19 and a sheet feed roller 21. The sheet tray 19 accommodates a sheet P in a stack. The sheet feed roller 21 rotates to feed the sheet P in a direction indicated by arrow in FIG. 1. Then, the sheet P is conveyed by a conveying roller pair 23 to a registration roller pair 25 (in other words, a positioning roller pair 25). After the registration roller pair 25 has corrected skew of the sheet P, the sheet P is conveyed to a transfer position of the image forming device 27 at a given timing.

The image forming device 27 is included in the image forming part 2 and functions as an image forming device to form an image on a surface of a sheet. The image forming device 27 includes a photoconductor drum 31 that functions as an image bearer and a transfer roller 33 that functions as a transfer member. Image forming units are disposed around the photoconductor drum 31 to perform image formation by electrophotographic processes. The image forming units are, for example, a charger, an exposure device, a developing device, a cleaning device, and an electrical discharging device. An electrophotographic latent image is formed in a surface of the photoconductor drum 31 to develop the latent image into a visible image with toner. Upon arrival of a sheet P at a given timing to a transfer nip that is formed between the transfer roller 33 and the photoconductor drum 31, the visible toner image is transferred onto the sheet P at the transfer nip.

A sheet sensor 44 is provided at a downstream side from the transfer nip in a sheet conveying direction. The sheet sensor 44 functions as a second detector to detect the sheet P that has passed through the transfer nip.

The fixing device 29 includes a fixing roller 35 and a pressure roller 37 to fix the toner image formed on the sheet P with toner by application of heat and pressure to the sheet P. After the toner image has been fixed to the sheet P in the fixing device 29, the sheet P is conveyed to the downstream side by a fixing ejection roller pair 39. The sheet P is conveyed from the sheet feeding part 15 by multiple conveying members such as the above-described rollers while being guided by a conveyance path 40.

The sheet ejecting part 4 includes a sheet ejection path 41, an ejection roller pair 45, and a sheet sensor 47. The sheet ejection path 41 is continuously connected and communicated with the conveyance path 40 to the sheet stacker 6. The ejection roller pair 45 is provided at a downstream end of the sheet ejection path 41 to eject the sheet P. The sheet sensor 47 detects the sheet P.

A sheet reversing part 49 is disposed between an area in which the image forming device 27 and the fixing device 29 are disposed and the sheet feeding part 15. The sheet reversing part 49 is used when both sides of the sheet P are printed.

The sheet reversing part 49 includes a sheet reversing path 51 and a sheet re-entry path 53. The sheet reversing path 51 is branched from the conveyance path 40 at a downstream side of the fixing device 29 in the sheet conveying direction. The sheet re-entry path 53 is branched from an upper side of the sheet reversing path 51 to merge with the conveyance path 40 at an upstream side of the registration roller pair 25 in the sheet conveying direction.

A separation claw 55 is provided at a branch section between the conveyance path 40 and the sheet reversing path 51. A separation claw 57 is provided at a branch section between the sheet reversing path 51 and the sheet re-entry path 53.

In a duplex printing mode (a duplex image forming mode), the sheet P having an image formed on one side thereof is guided to the sheet reversing path 51 by the separation claw 55. Then, the sheet P is switched back by a given amount by the conveying roller pair 61 and is held substantially vertically in the sheet reversing path 51. There, the sheet P is reversed so that a trailing edge of the sheet P is turned to a leading edge thereof. Thereafter, the sheet P is guided to the sheet re-entry path 53 by the separation claw 57. The sheet P that is guided to the sheet re-entry path 53 is conveyed by multiple conveying roller pairs 63 provided along the sheet re-entry path 53 to be conveyed toward the transfer nip of the image forming device 27 again.

A cooling fan 10 that functions as a cooler is disposed in the vicinity of the image forming device 27 to cool the photoconductor drum 31 and the developing device.

A temperature sensor 5 that functions as a temperature detector is disposed in the vicinity of the apparatus body 3. It is to be noted that the temperature sensor 5 can be disposed at any position of the apparatus body 3 as long as the temperature sensor 5 can measure an outside temperature, which is a temperature outside the apparatus body 3.

Figure 2:
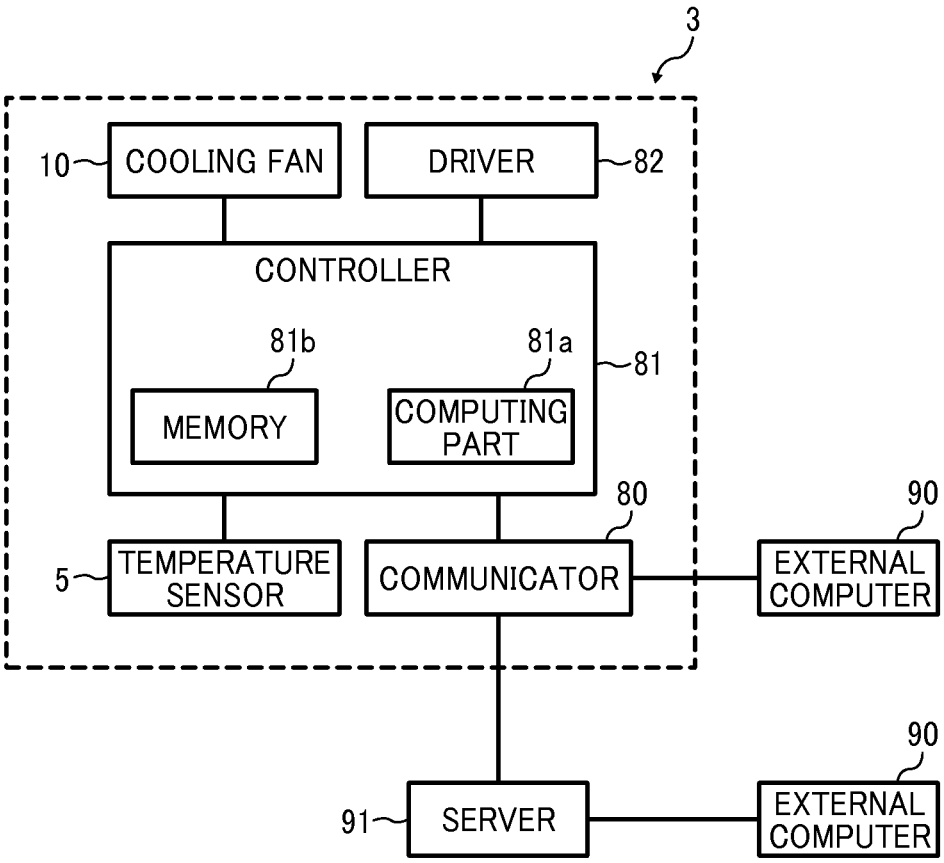
FIG. 2 is a diagram illustrating a functional configuration of the image forming apparatus of FIG. 1.

Next, a description is given of a functional configuration of the image forming apparatus 1 with reference to FIG. 2.

The apparatus body 3 includes a driver 82, a communicator 80, a controller 81, the cooling fan 10, and the temperature sensor 5.

The driver 82, for example, drives image forming components performing image formation, such as the photoconductor drum 31.

The communicator 80 receives information such as image data transmitted from external computers 90 such as personal computers via a network. It is to be noted that the communicator 80 may receive information such as image data from the external computers 90 via a server 91 instead of the network. After receiving the information, the communicator 80 transmits the information to the controller 81.

The controller 81 controls driving of the driver 82 and driving of the cooling fan 10 based on the information transmitted by the communicator 80.

The temperature sensor 5 measures an outside temperature of an area where the image forming apparatus 1 is installed. Information of the outside temperature measured by the temperature sensor 5 is sent to the controller 81.

The controller 81 includes a computing part 81*a* and a memory 81*b*.

The computing part 81*a* counts a period of driving of the driver 82. For example, if the driver 82 is driven, the computing part 81*a* performs counting. By contrast, if the driver 82 is not driven, the computing part 81*a* stops counting.

It is to be noted that the driver 82 may change the number of counts according to a driving speed thereof. For example, the number of counts may be 2 per second when the driver 82 drives at a regular speed of driving operation, 1 per second when the driver 82 drives at a speed lower than the regular speed of driving operation, and 3 per second when the driver 82 drives at a speed higher than the regular speed of driving operation. Alternatively, the number of counts may be 1 per second when the driver 82 is driven and −1 (minus one) per second when the driver 82 is stopped.

The information counted by the computing part 81*a* is written into the memory 81*b* and stored as a counter value.

The controller 81 controls the driver 82 and/or the cooling fan 10 based on a counter value C stored in the memory 81*b* and the information obtained by the temperature sensor 5. It is to be noted that the controller 81 in the present example, the controller 81 controls the driver 82 and/or the cooling fan 10 in the present example. However, the configuration is not limited thereto. For example, the controller 81 may be multiple controllers.

Next, a description is given of various examples of controls of the driver 82 and/or the cooling fan 10 performed by the controller 81, with reference to flowcharts. It is to be noted that the flowcharts explain examples of routines to be effective to this disclosure in the following examples, and therefore any other flowcharts can be applied within the skill of the art.

Figure 3:
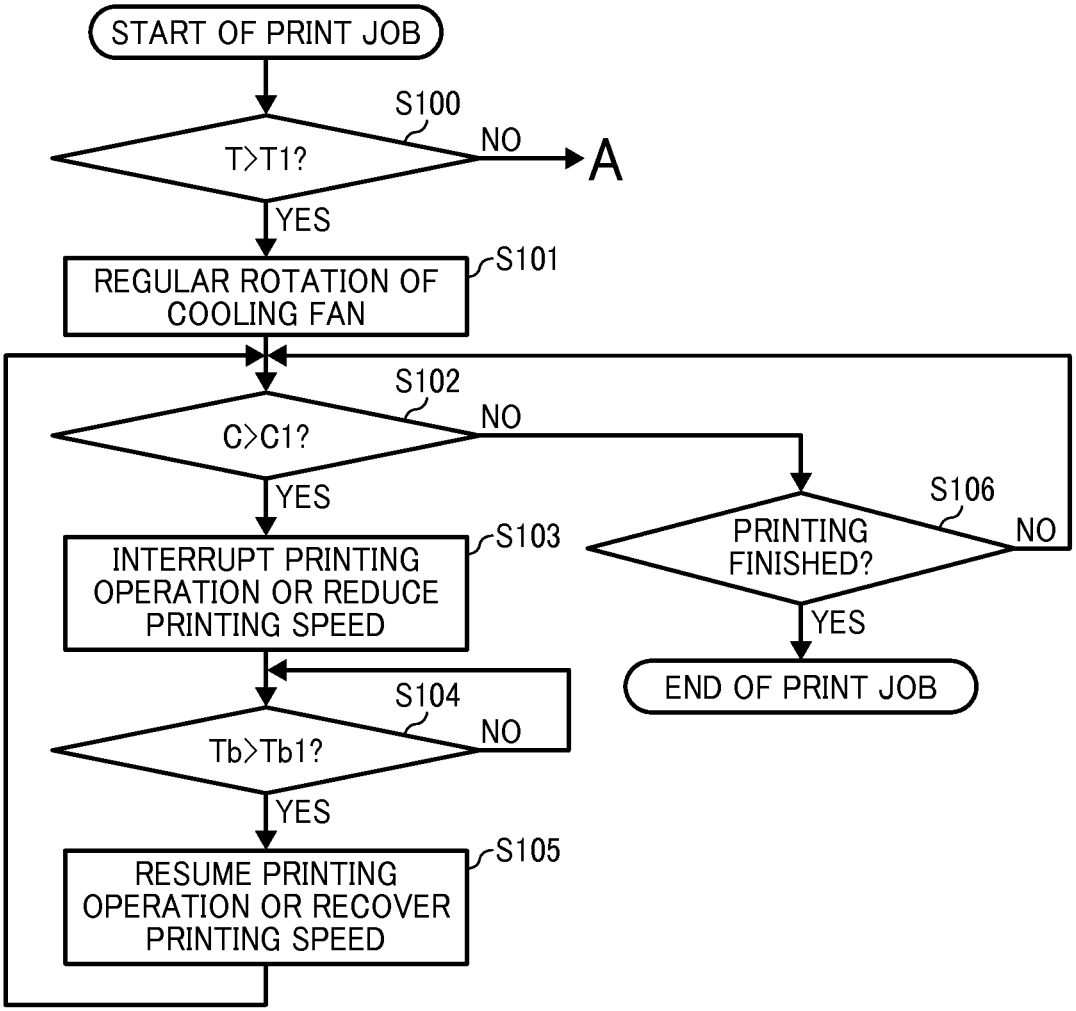
FIG. 3 is a portion of a flowchart of a print job under a control performed in the image forming apparatus of FIG. 1.
Figure 4:
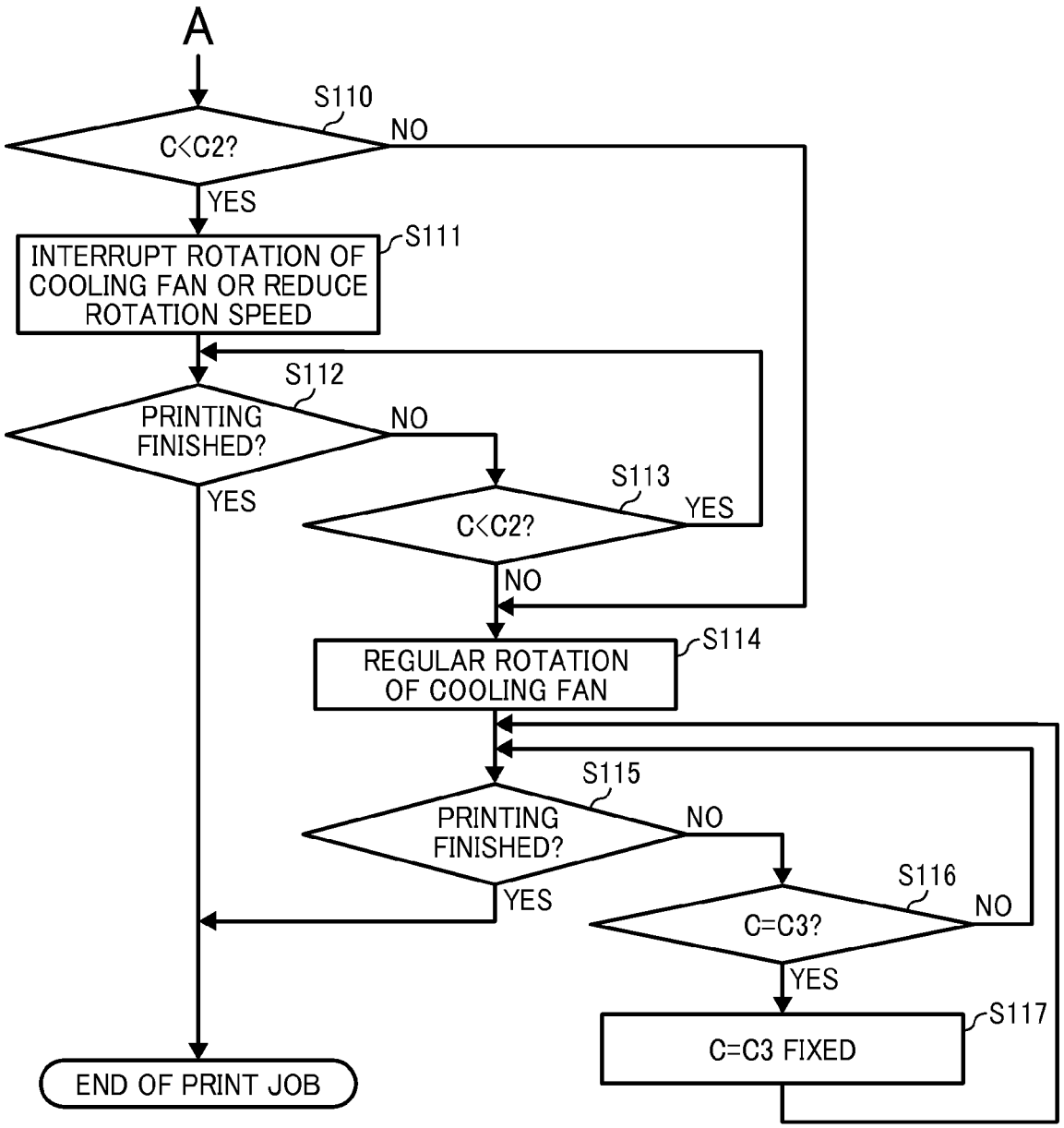
FIG. 4 is another portion of the flowchart of the print job associated with FIG. 3.

Now, a description is given of a print job based on a control with reference to a flowchart in FIGS. 3 and 4.

When the print job based on the control illustrated in FIGS. 3 and 4 is started, the controller 81 determines whether or not a temperature T obtained by the temperature sensor 5 is T>T1 in step S100. "T1" represents, for example, a reference temperature at a boundary between a normal temperature and a high temperature that is higher than the normal temperature. It is to be noted that it is described as a high temperature environment when a relation of the temperature T and the temperature T1 is T>T1 and as a medium-low temperature environment when the relation is not T>T1.

When it is determined that the state is T>T1, the controller 81 controls the cooling fan 10 to rotate at a regular speed thereof in step S101.

Then, the controller 81 determines whether or not the counter value C is C>C1 in step S102. "C1" represents a first counter threshold and, for example, a counter value that corresponds to a surface temperature of the photoconductor drum 31 which is to be restrained from increasing. It is to be noted that the first counter threshold C1 is not limited to the surface temperature of the photoconductor drum 31 but may be applied to a temperature of any parts included in the image forming device 27.

When it is determined that the state is C>C1, the controller 81 controls the driver 82 either to interrupt a printing operation or to reduce a printing speed in step S103. The printing operation of the driver 82 represents a driving of the image forming components such as the image forming device 27 and the printing speed of the driver 82 represents a speed of driving the image forming components such as the image forming device 27 and the conveying roller pair 23.

Then, the controller 81 determines whether or not an elapsed time Tb after the controller 81 has interrupted the printing operation or reduced the printing speed is Tb>Tb1 in step S104. "Tb1" represents an estimated time obtained by estimating that the surface temperature of the photoconductor drum 31 is decreased by a certain amount. It is to be noted that the present example employs the estimated time taken when the surface temperature of the photoconductor drum 31 is reduced as a parameter. However, it is not limited thereto and a counter value obtained by estimating that the surface temperature of the photoconductor drum 31 drops may be employed as a parameter.

When it is determined that the state is Tb>Tb1, the controller 81 controls the driver 82 in order to resume the printing operation or recover the printing speed in step S105, and the procedure goes back to step S102.

By contrast, when it is determined that the state is not Tb>Tb1, the controller 81 causes the procedure to return to step S104.

When it is determined that the state is not C>C1 in step S102, the controller 81 determines whether or not to finish the printing operation of the driver 82 in step S106. When the controller 81 causes the driver 82 to finish the printing operation, the controller 81 ends the print job based on the control illustrated in FIGS. 3 and 4.

By contrast, when the controller 81 does not cause the driver 82 to finish the printing operation, the procedure goes back to step S102.

When it is determined that the state is not T>T1 in step S102, the procedure goes to A. In the procedure A, as illustrated in FIG. 4, the controller 81 determines whether or not the counter value C is C<C2 in step S110. "C2" represents a second counter threshold that is smaller than the first counter threshold C1 and, for example, a counter value that corresponds to the surface temperature of the photoconductor drum 31 which is not to be restrained from increasing. It is to be noted that the second counter threshold C2 is not limited to the surface temperature of the photoconductor drum 31 but may be applied to a temperature of any parts included in the image forming device 27.

When it is determined that the state is C<C2, the controller 81 controls the cooling fan 10 either to reduce a speed of rotation thereof to be lower than a regular speed or to interrupt the rotation thereof in step S111.

Then, the controller 81 determines whether or not to finish the printing operation of the driver 82 in step S112. When the printing operation driven by the driver 82 is finished, the controller 81 ends the print job based on the control of the flowchart in FIGS. 3 and 4.

By contrast, when the printing operation driven by the driver 82 is not finished, the controller 81 determines whether or not the counter value C is C<C2 in step S113.

When it is determined that the state is C<C2, the procedure returns to step S112.

By contrast, when it is determined that the state is not C<C2, the controller 81 controls the cooling fan 10 to rotate at the regular speed in step S114.

Then, the controller 81 determines whether or not to finish the printing operation driven by the driver 82 in step S115. When the printing operation driven by the driver 82 is finished, the controller 81 ends the print job based on the control of the flowchart in FIGS. 3 and 4.

When the printing operation driven by the driver 82 is not finished, the controller 81 determines whether or not the counter value is C=C3 in step S116. "C3" represents a third counter threshold that is smaller than the first counter threshold C1 and greater than the second counter threshold C2. Further, the third counter threshold C3 is, for example, a counter value that corresponds to the surface temperature of the photoconductor drum 31 which is saturated when the state is not T>T1. It is to be noted that the third counter threshold C3 is not limited to the surface temperature of the photoconductor drum 31 but may be applied to a temperature of any parts included in the image forming device 27.

When it is determined that the state is C=C3, the controller 81 sets the counter value C to the third counter threshold C3 in step S117. The counter value C is set to the third counter threshold C3 after the controller 81 has written the third counter threshold C3 to the memory 81*b* as a counter value. Then, the procedure returns to step S115. It is to be noted that, after the counter value C is set to the third counter threshold C3, the setting of the counter value C to the third counter threshold C3 may last until the end of the print job.

By contrast, when it is determined that the state is not C=C3, the procedure returns to step S115.

When it is determined that the state is not C<C2 in step S110, the procedure goes to step S114.

Figure 5:
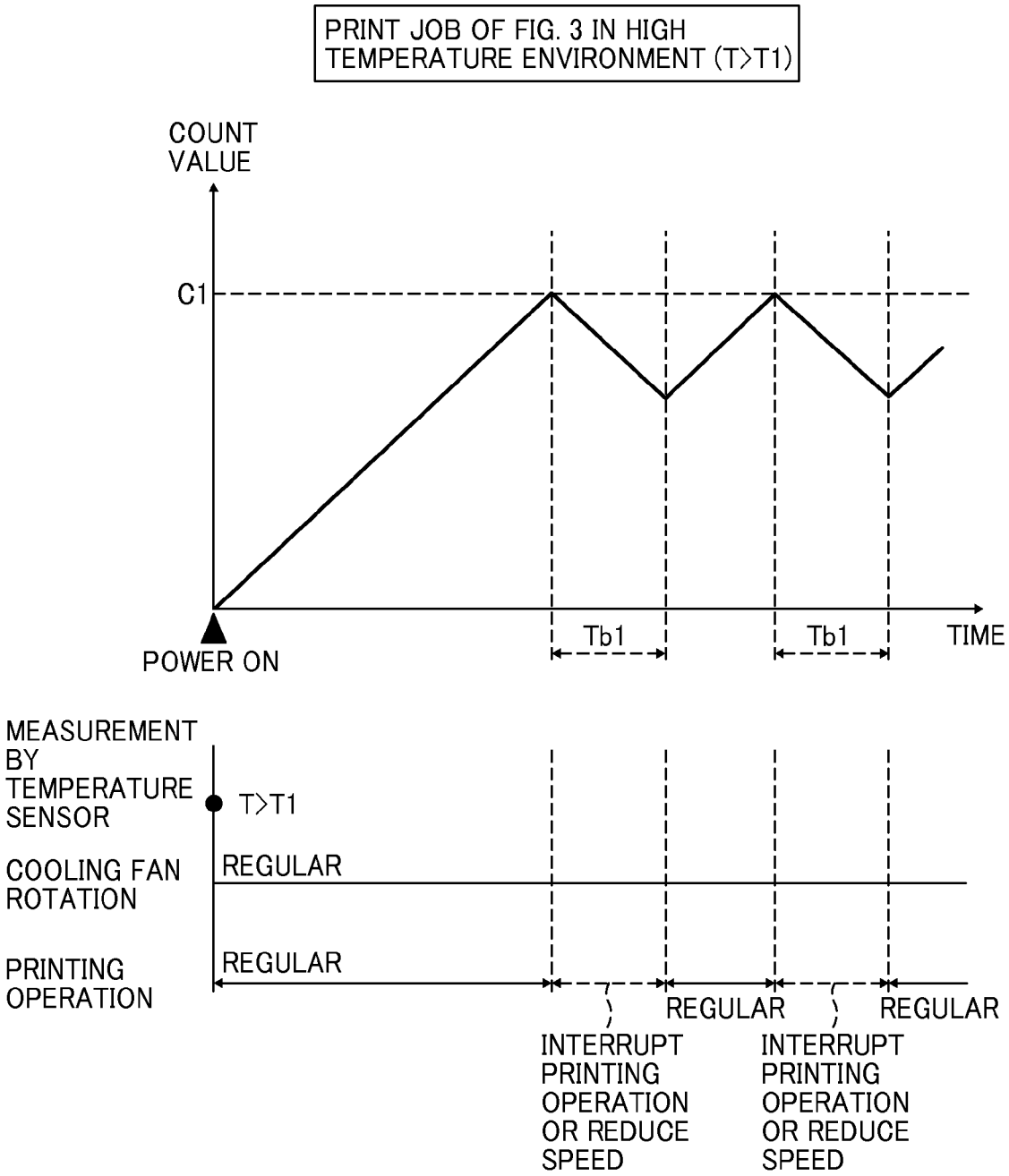
FIG. 5 is a graph of the print job performed under the control of the flowchart in FIGS. 3 and 4 in the image forming apparatus of FIG. 1 in a high temperature.
Figure 6:
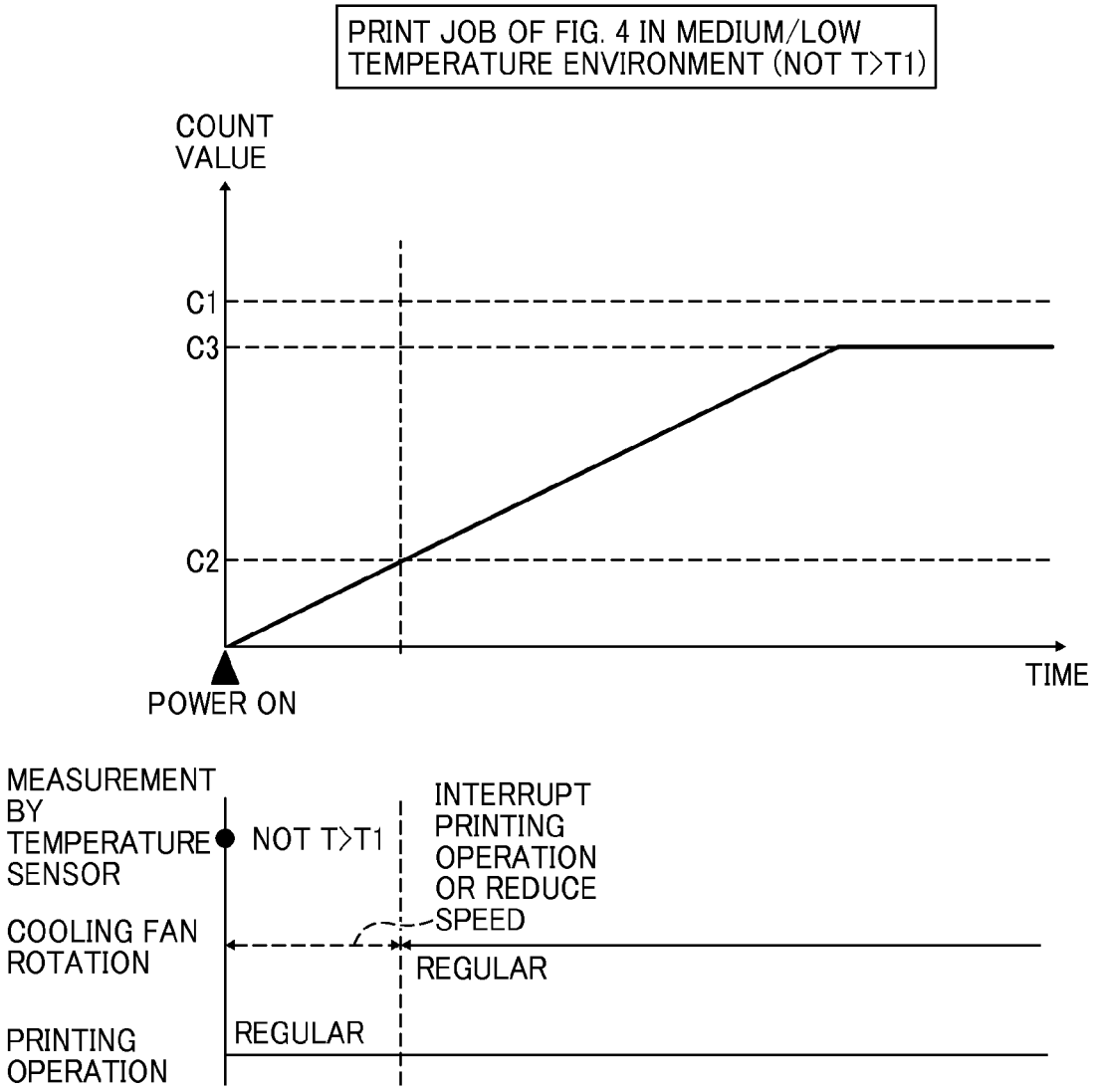
FIG. 6 is a graph of the print job performed under the control of the flowchart in FIGS. 3 and 4 in the image forming apparatus of FIG. 1 in a medium/low temperature.

Next, a description is given of the print job based on the control of the flowchart in FIGS. 3 and 4, with reference to diagrams illustrated in FIGS. 5 and 6.

After a power supply of the image forming apparatus 1 is turned on, the print job based on the control of the flowchart in FIGS. 3 and 4 starts. When the controller 81 determines that the state is T>T1, the controller 81 controls the cooling fan 10 to rotate at the regular speed thereof, as illustrated in FIG. 5 in step S101. At this time, the controller 81 controls the driver 82 to perform the printing operation at the regular speed of rotation. Then, the controller 81 determines whether or not the state is C>C1 in step S102.

When it is determined that the state is C>C1, the controller 81 controls the driver 82 either to interrupt the printing operation driven by the driver 82 or to reduce the printing speed in step S103. At this time, the controller 81 controls the cooling fan 10 to rotate at the regular speed thereof. Then, after the elapsed time Tb has passed the given estimated time Tb1 after an interruption of the printing operation driven by the driver 82 or a reduction in the printing speed, the controller 81 controls the driver 82 to perform the printing operation at the regular speed of operation in step S105. At this time, the controller 81 controls the cooling fan 10 to rotate at the regular speed thereof. Then, the controller 81 determines whether or not the state is C>C1 in step S102. When it is determined that the state is C>C1, the controller 81 controls the driver 82 either to interrupt the printing operation or to reduce the printing speed in step S103. As described above, the routine of steps S102 through S105 is repeated until the printing operation driven by the driver 82 is finished.

As previously described, after the power supply of the image forming apparatus 1 is turned on, the print job based on the control of the flowchart in FIGS. 3 and 4 starts. When the controller 81 determines that the state is not T>T1 but is C<C2, the controller 81 controls the cooling fan 10 either to reduce the speed of rotation thereof to be lower than the regular speed or to interrupt the rotation thereof in step S111, as illustrated in FIG. 6. At this time, the controller 81 controls the driver 82 to perform the printing operation at the regular speed of operation.

Then, when it is determined that the state is not C<C2, the controller 81 controls the cooling fan 10 to rotate at the regular speed in step S114. At this time, the controller 81 controls the driver 82 to perform the printing operation at the regular speed of operation.

The controller 81 determines whether or not the state is C=C3 in step S116. When it is determined that the state is C=C3, the controller 81 sets the counter value C to the third counter threshold C3 in step S117. At this time, the controller 81 controls the cooling fan 10 to rotate at the regular speed. Furthermore, the controller 81 controls the driver 82 to perform the printing operation at the regular speed of operation. As described above, the routine of steps S116 through S117 is repeated until the printing operation driven by the driver 82 is finished.

Figure 7:
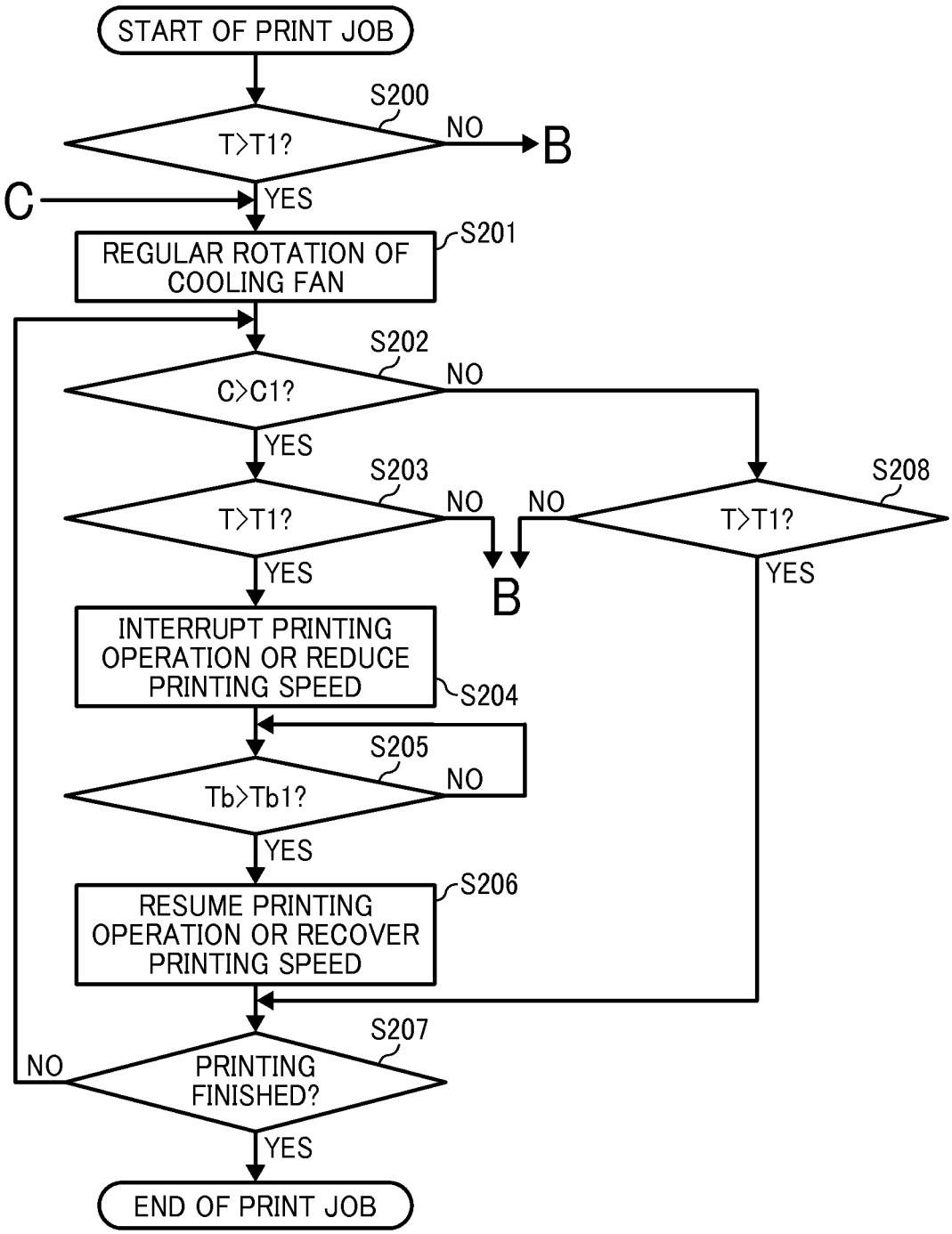
FIG. 7 is a portion of a flowchart of a print job under another control performed in the image forming apparatus of FIG. 1.
Figure 8:
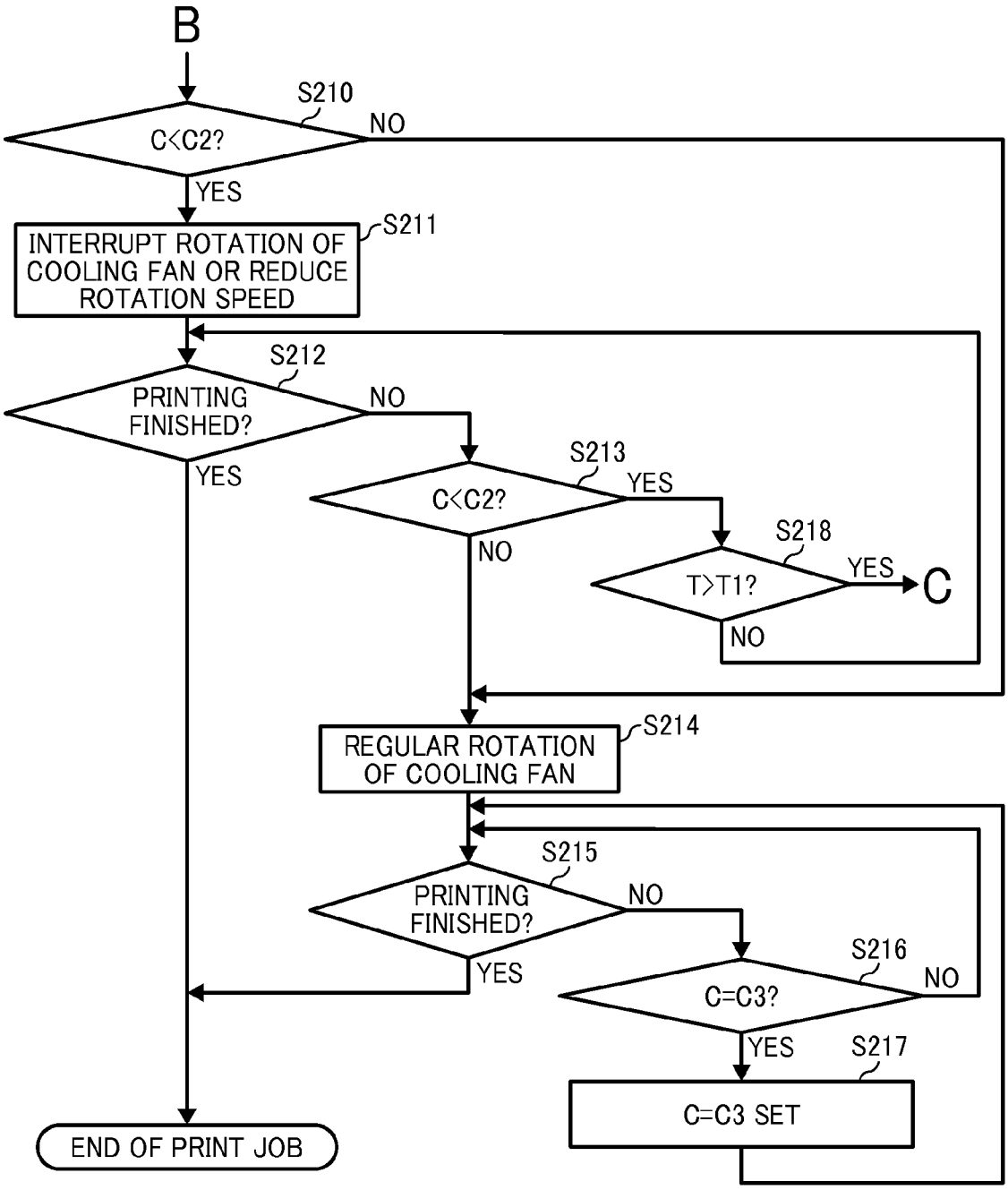
FIG. 8 is another portion of the flowchart of the print job associated with FIG. 7.

Now, a description is given of a print job based on another control with reference to a flowchart in FIGS. 7 and 8.

When the print job based on the control of the flowchart in FIGS. 7 and 8 is started, the controller 81 determines whether or not an outside temperature T obtained by the temperature sensor 5 is T>T1 in step S200.

When it is determined that the state is T>T1, the controller 81 controls the cooling fan 10 to rotate at the regular speed in step S201.

Then, the controller 81 determines whether or not the counter value C is C>C1 in step S202.

When it is determined that the state is C>C1, the controller 81 determines whether or not the outside temperature T obtained by the temperature sensor 5 is T>T1 in step S203.

When it is determined that the state is T>T1, the controller 81 controls the driver 82 either to interrupt the printing operation or to reduce the printing speed in step S204.

Then, the controller 81 determines whether or not the elapsed time Tb after the controller 81 has caused the driver 82 to interrupt the printing operation or reduce the printing speed is Tb>Tb1 in step S205.

When it is determined that the state is not Tb>Tb1, the controller 81 causes the procedure to return to step S205.

By contrast, when it is determined that the state is Tb>Tb1, the controller 81 controls the driver 82 in order to resume the printing operation or recover the printing speed in step S206. Then, the controller 81 determines whether or not to finish the printing operation driven by the driver 82 in step S207.

When the printing operation driven by the driver 82 is finished, the controller 81 ends the print job based on the control of the flowchart in FIGS. 7 and 8.

When the printing operation driven by the driver 82 is finished, the controller 81 ends the print job based on the control of the flowchart in FIGS. 7 and 8.

By contrast, when the printing operation driven by the driver 82 is not finished, the procedure returns to step S202.

When it is determined that the state is not T>T1 in step S203, the procedure goes to B.

When it is determined that the state is not C>C1 in step S202, the controller 81 determines whether or not the outside temperature T obtained by the temperature sensor 5 is T>T1 in step S208. When it is determined that the state is T>T1, the procedure goes to step S207.

By contrast, when it is determined that the state is not T>T1, the procedure goes to B.

When it is determined that the state is not T>T1 in step S200, the procedure goes to B.

In the procedure B, as illustrated in FIG. 8, the controller 81 determines whether or not the counter value C is C<C2 in step S210.

When it is determined that the state is C<C2, the controller 81 controls the cooling fan 10 either to reduce the speed of rotation thereof to be lower than the regular speed or to interrupt the rotation thereof in step S211.

Then, the controller 81 determines whether or not to finish the printing operation driven by the driver 82 in step S212.

When the printing operation driven by the driver 82 is finished, the controller 81 ends the print job based on the control of the flowchart in FIGS. 7 and 8.

By contrast, when the printing operation driven by the driver 82 is not finished, the controller 81 determines whether or not the counter value C is C<C2 in step S213.

When it is determined that the state is not C<C2, the controller 81 controls the cooling fan 10 to rotate at the regular speed in step S214.

Then, the controller 81 determines whether or not to finish the printing operation driven by the driver 82 in step S215.

When the printing operation driven by the driver 82 is finished, the controller 81 ends the print job based on the control of the flowchart in FIGS. 7 and 8.

When the printing operation driven by the driver 82 is not finished, the controller 81 determines whether or not the counter value is C=C3 in step S216.

When it is determined that the state is C=C3, the controller 81 sets the counter value C to the third counter threshold C3 in step S217. Then, the procedure returns to step S215. It is to be noted that, after the counter value C is set to the third counter threshold C3, the setting of the counter value C to the third counter threshold C3 may last until the printing operation driven by the driver 82 comes to a finish.

By contrast, when it is determined that the state is not C=C3, the procedure returns to step S215.

When it is determined that the state is C<C2 in step S213, the controller 81 determines whether or not the outside temperature T is T>T1 in step S218.

When it is determined that the state is not T>T1, the procedure returns to step S212.

When it is determined that the state is T>T1, the procedure goes to C and then to step S201.

Figure 9:
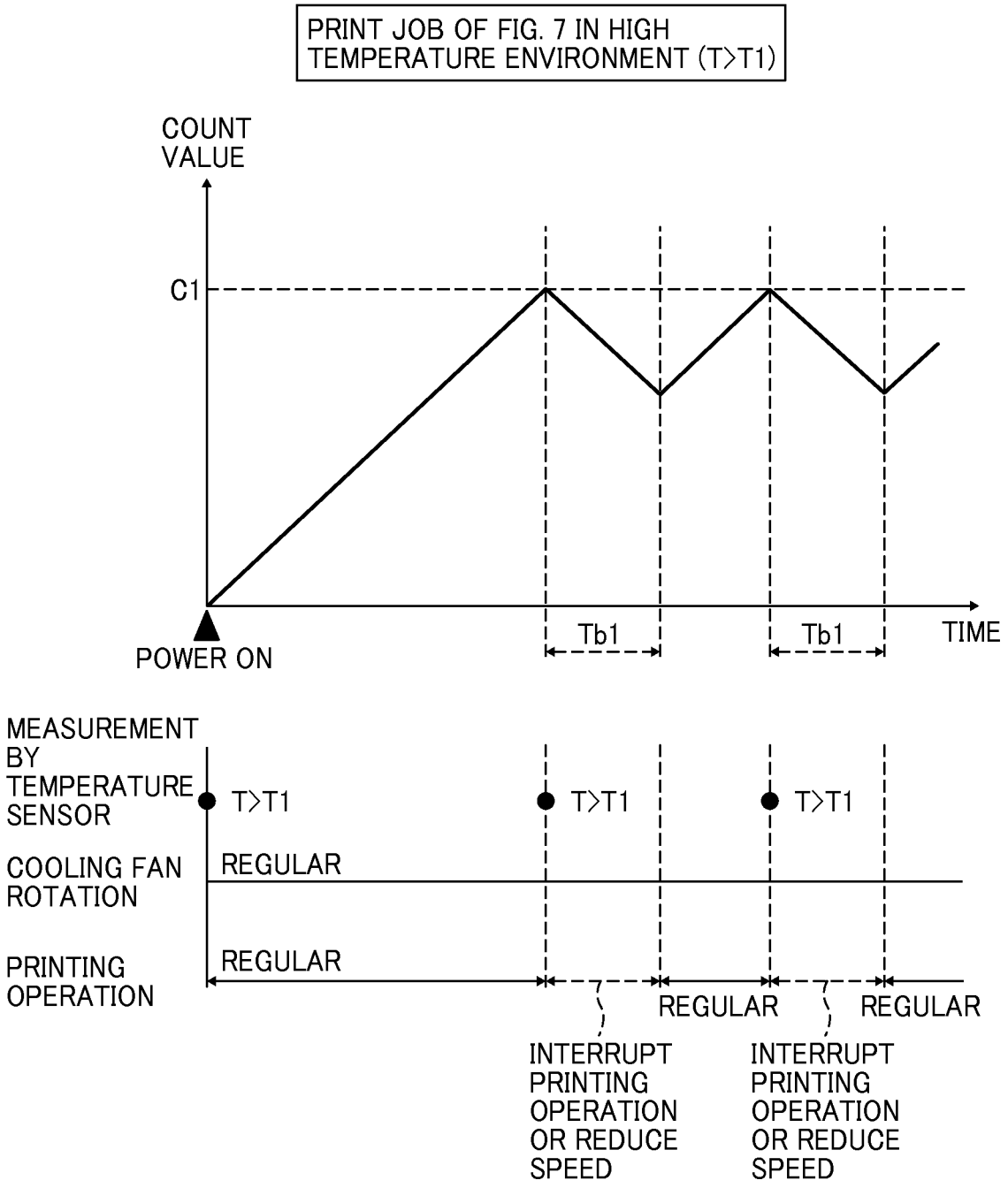
FIG. 9 is a graph of the print job performed under the control of the flowchart in FIGS. 7 and 8 in the image forming apparatus of FIG. 1 in a high temperature.
Figure 10:
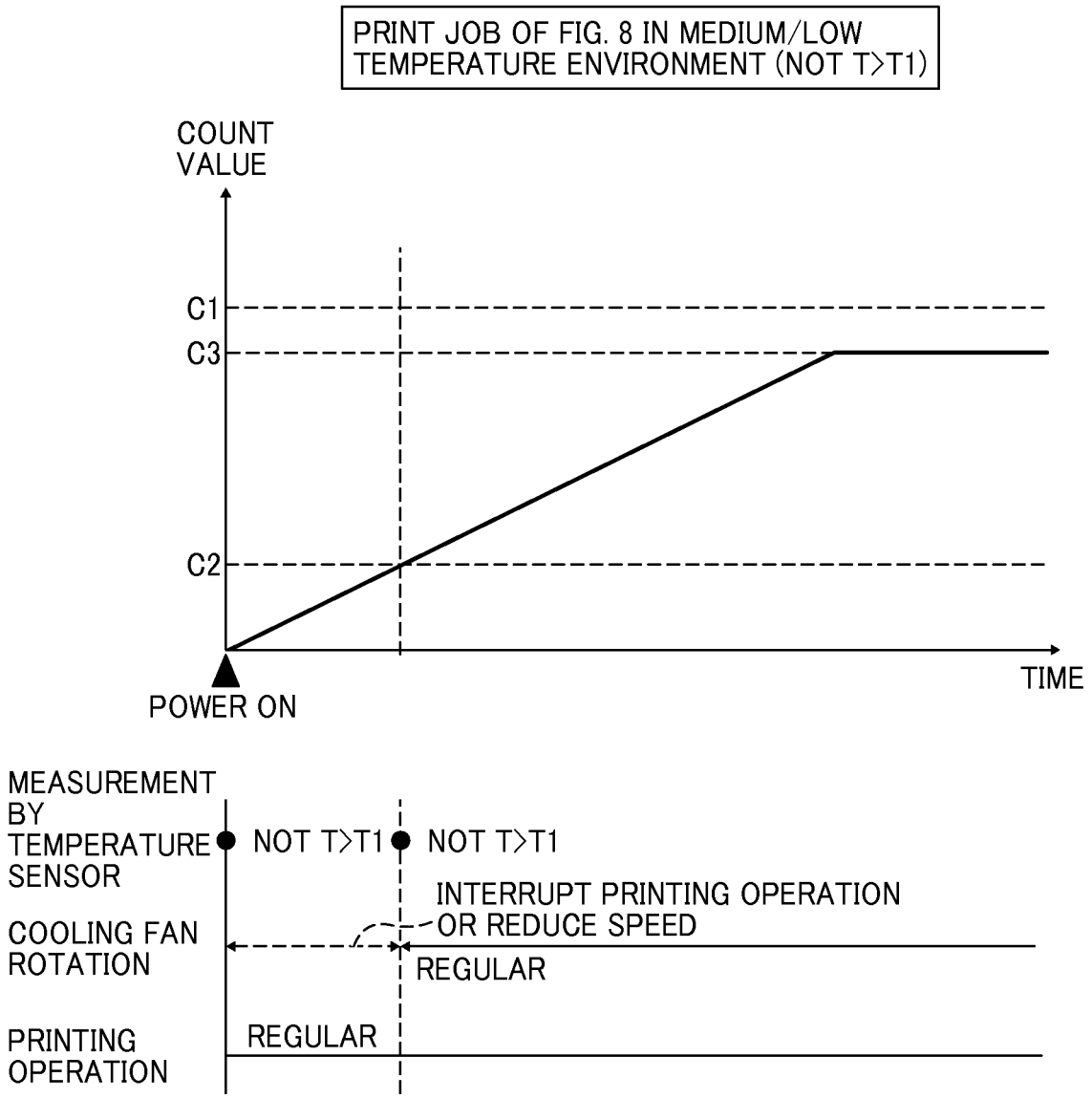
FIG. 10 is a graph of the print job performed under the control of the flowchart in FIGS. 7 and 8 in the image forming apparatus of FIG. 1 in a medium/low temperature.

Next, a description is given of the print job based on the control of the flowchart in FIGS. 7 and 8, with reference to diagrams illustrated in FIGS. 9 and 10.

After the power supply of the image forming apparatus 1 is turned on, the print job based on the control of the flowchart in FIGS. 7 and 8 starts. When the controller 81 determines that the state is T>T1, the controller 81 controls the cooling fan 10 to rotate at the regular speed thereof, as illustrated in FIG. 9 in step S201. At this time, the controller 81 controls the driver 82 to perform the printing operation at the regular speed of rotation. Then, the controller 81 determines whether or not the state is C>C1 in step S202.

When it is determined that the state is C>C1 and is also T>T1, the controller 81 controls the driver 82 either to interrupt the printing operation or to reduce the printing speed in step S204. Then, after the elapsed time Tb has passed the given estimated time Tb1 after an interruption of the printing operation of the driver 82 or a reduction in the printing speed of the driver 82, the controller 81 controls the driver 82 to perform the printing operation at the regular speed of operation in step S206. At this time, the controller 81 controls the cooling fan 10 to rotate at the regular speed thereof. Then, the controller 81 determines whether or not the state is C>C1 in step S202. When it is determined that the state is C>C1, the controller 81 controls the driver 82 either to interrupt the printing operation or to reduce the printing speed in step S204. As described above, the routine of steps S202 through S206 is repeated until the printing operation driven by the driver 82 comes to a finish.

As previously described, after the power supply of the image forming apparatus 1 is turned on, the print job based on the control of the flowchart in FIGS. 7 and 8 starts. When the controller 81 determines that the state is not T>T1 but is C<C2, the controller 81 controls the cooling fan 10 either to reduce the speed of rotation thereof to be lower than the regular speed or to interrupt the rotation thereof in step S211, as illustrated in FIG. 10. At this time, the controller 81 controls the driver 82 to perform the printing operation at the regular speed of operation.

Then, when it is determined that the state is not C<C2, the controller 81 controls the cooling fan 10 to rotate at the regular speed in step S214. At this time, the controller 81 controls the driver 82 to perform the printing operation at the regular speed of operation.

The controller 81 determines whether or not the state is C=C3 in step S216. When it is determined that the state is C=C3, the controller 81 sets the counter value C to the third counter threshold C3 in step S217. At this time, the controller 81 controls the cooling fan 10 to rotate at the regular speed. Furthermore, the controller 81 controls the driver 82 to perform the printing operation at the regular speed of operation. As described above, the routine of steps S216 through S217 is repeated until the printing operation driven by the driver 82 comes to a finish.

It is to be noted that the determination timing in which the controller 81 determines whether or not the outside temperature T obtained by the temperature sensor 5 is T>T1 is not limited to the above-described configuration but may be determined occasionally. For example, the controller 81 can determine every second whether or not the outside temperature T obtained by the temperature sensor 5 is T>T1.

Figure 11:
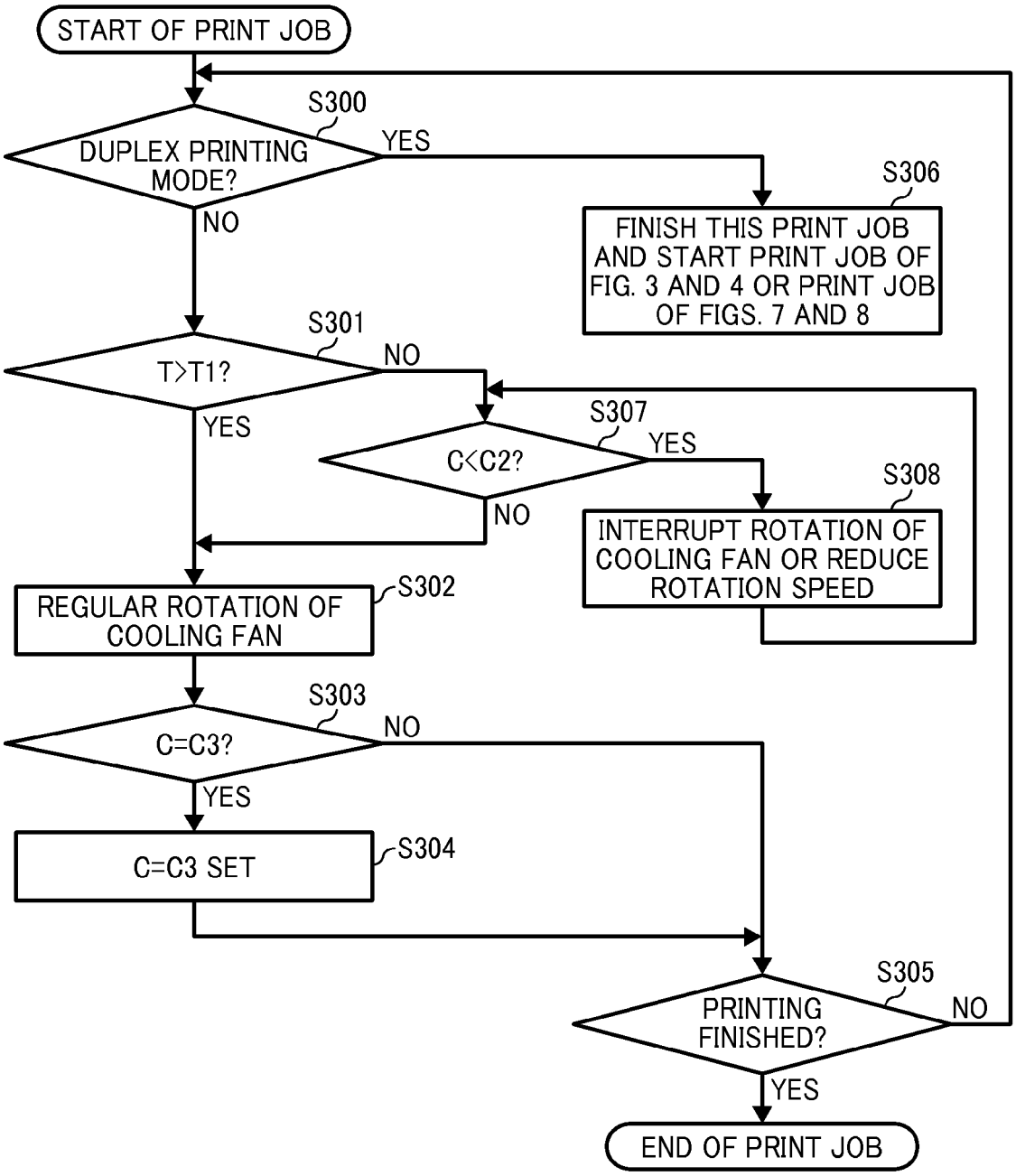
FIG. 11 is a flowchart of a print job performed under a control performed in the image forming apparatus of FIG. 1.

Now, a description is given of a print job based on yet another control with reference to a flowchart in FIG. 11.

When the print job based on the control of the flowchart in FIG. 11 is started, the controller 81 determines, based on information from the communicator, whether or not a duplex printing mode is selected in step S300.

When it is determined that the duplex printing mode is not selected, in other words, that a single sided printing mode (a simplex image forming mode) is selected, the controller 81 determines whether or not the outside temperature T obtained by the temperature sensor 5 is T>T1 in step S301.

When it is determined that the state is T>T1, the controller 81 controls the cooling fan 10 to rotate at the regular speed in step S302.

Then, the controller 81 determines whether or not the counter value C is C=C3 in step S303.

When it is determined that the state is C=C3, the controller 81 sets the counter value C to the third counter threshold C3 in step S304. Then, the controller 81 determines whether or not to finish the printing operation driven by the driver 82 in step S305.

When the printing operation driven by the driver 82 is finished, the controller 81 ends the print job based on the control of the flowchart in FIG. 11.

By contrast, when the printing operation driven by the driver 82 is not finished, the procedure returns to step S300.

When it is determined that the duplex printing mode is selected in step S300, the print job based on the control of the flowchart in FIG. 11 ends. Thereafter, either one of the print job based on the control of the flowchart in FIGS. 3 and 4 and the print job based on the control of the flowchart in FIGS. 7 and 8 starts in step S306.

When it is determined that the state is not T>T1 in step S301, the controller 81 determines whether or not the counter value C is C<C2 in step S307.

When it is determined that the state is not C<C2, the procedure goes to step S302.

By contrast, when it is determined that the state is C<C2, the controller 81 controls the cooling fan 10 either to reduce the speed of rotation thereof to be lower than the regular speed or to interrupt the rotation thereof in step S308, and then the procedure goes back to step S307.

Figure 12:
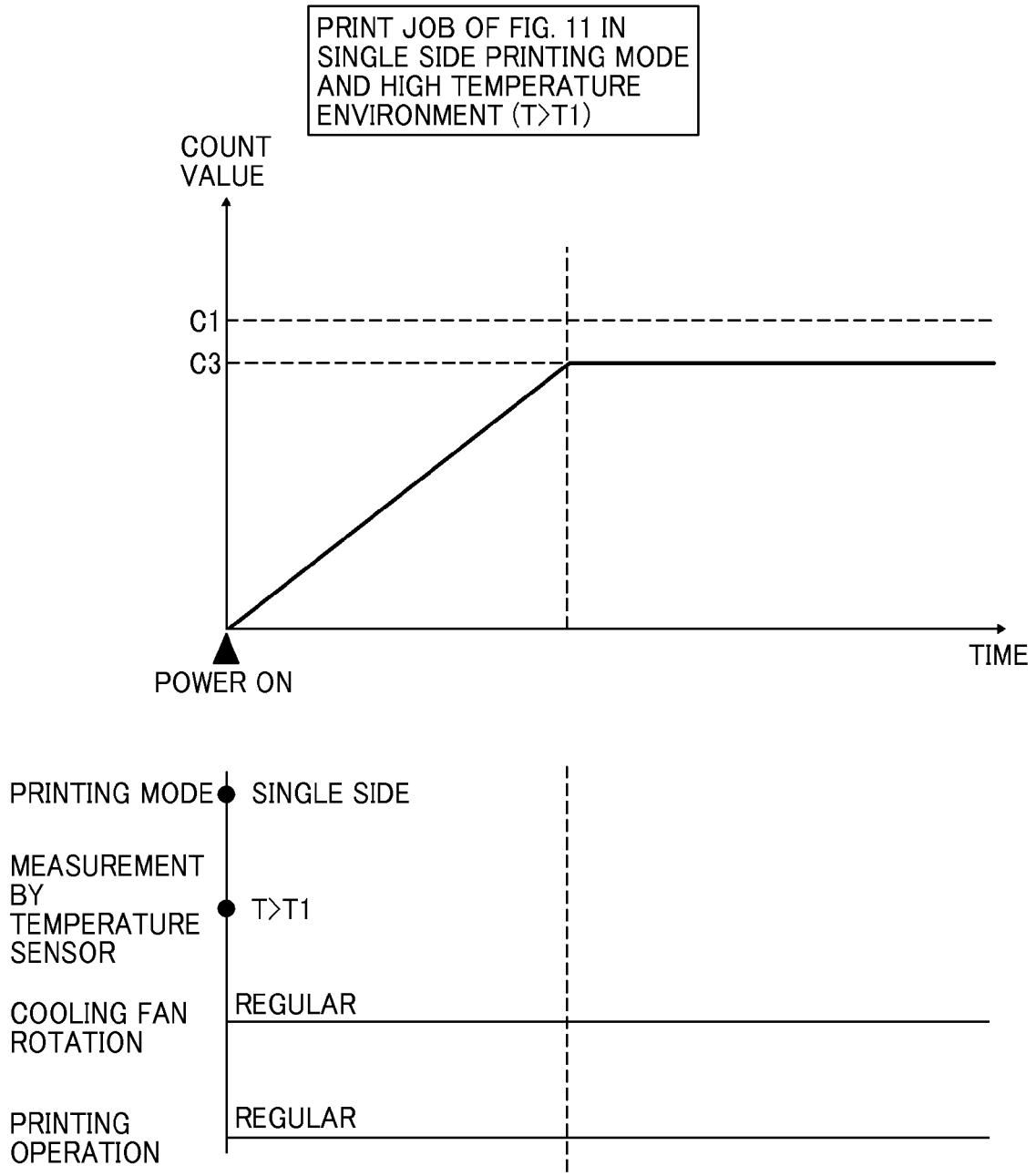
FIG. 12 is a graph of the print job performed under the control of the flowchart in FIG. 11 in the image forming apparatus of FIG. 1 in a high temperature.
Figure 13:
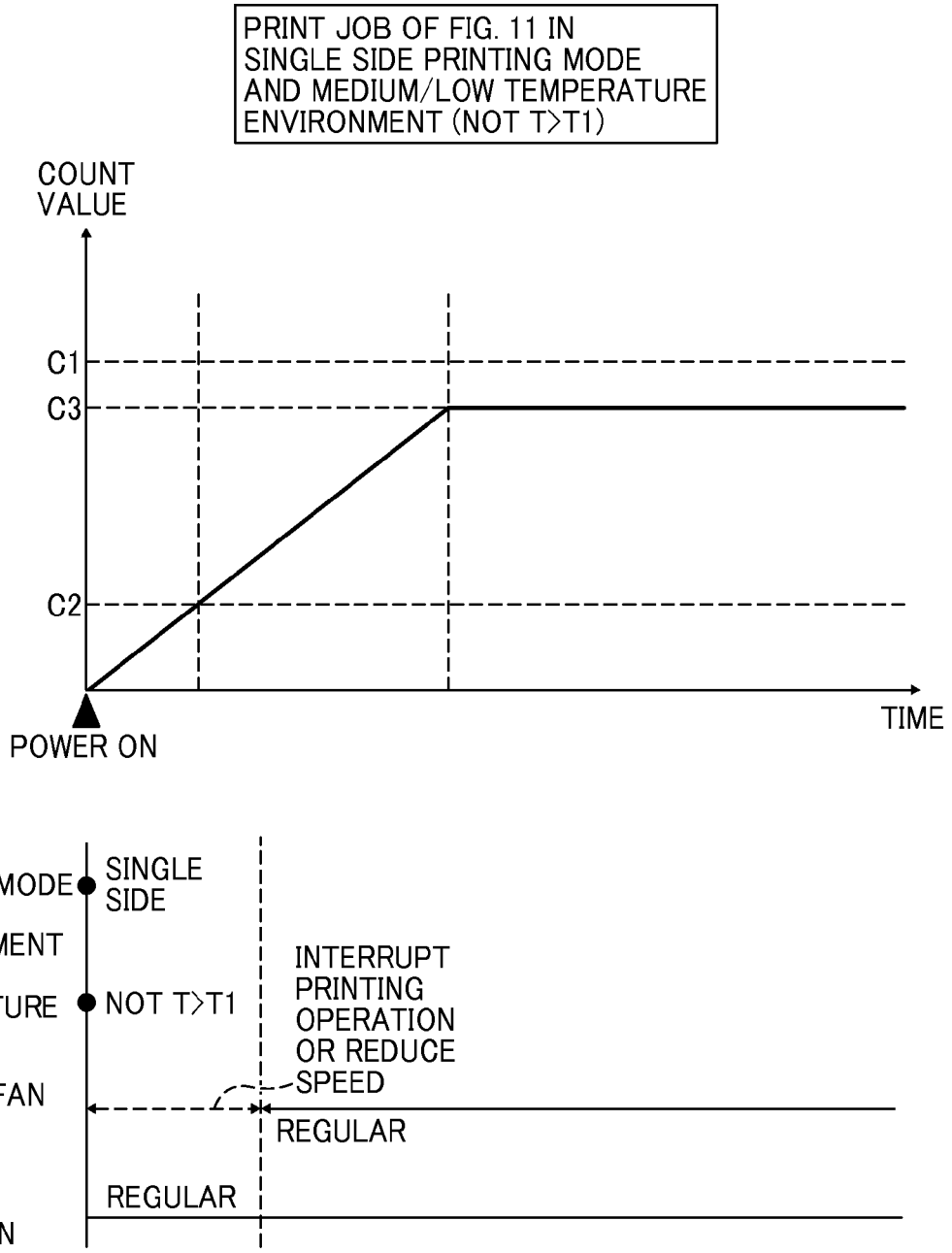
FIG. 13 is a graph of the print job performed under the control of the flowchart in FIG. 11 in the image forming apparatus of FIG. 1 in a medium/low temperature.

Next, a description is given of the print job based on the control of the flowchart in FIG. 11, with reference to diagrams illustrated in FIGS. 12 and 13.

After the power supply of the image forming apparatus 1 is turned on, the print job based on the control of the flowchart in FIG. 11 starts. When the controller 81 determines that the single sided printing mode is selected and the state is T>T1, the controller 81 controls the cooling fan 10 to rotate at the regular speed thereof, as illustrated in FIG. 12 in step S302. At this time, the controller 81 controls the driver 82 to perform the printing operation at the regular speed of rotation. When it is determined that the state is C=C3, the controller 81 sets the counter value C to the third counter threshold C3 in step S304. At this time, the controller 81 controls the cooling fan 10 to rotate at the regular speed thereof. Furthermore, the controller 81 controls the driver 82 to perform the printing operation at the regular speed of operation. As described above, the counter value C continues to be the third counter threshold C3 until the printing operation driven by the driver 82 comes to a finish.

As previously described, after the power supply of the image forming apparatus 1 is turned on, the print job based on the control of the flowchart in FIG. 11 starts. When it is determined that the single sided printing mode is selected and that the state is not T>T1 but is C<C2, the controller 81 controls the cooling fan 10 either to reduce the speed of rotation thereof to be lower than the regular speed or to interrupt the rotation thereof in step S308, as illustrated in FIG. 13.

When it is determined that the state is not C<C2, the controller 81 controls the cooling fan 10 to rotate at the regular speed in step S302. At this time, the controller 81 controls the driver 82 to perform the printing operation at the regular speed of operation.

When it is determined that the state is C=C3, the controller 81 sets the counter value C to the third counter threshold C3 in step S304. At this time, the controller 81 controls the cooling fan 10 to rotate at the regular speed. Further, the controller 81 controls the driver 82 to perform the printing operation at the regular speed of operation. Then, the counter value C continues to be the third counter threshold C3 until the printing operation driven by the driver 82 comes to a finish.

Next, a description is given of an image forming apparatus according to a comparative example.

The temperature in an image forming device of the comparative image forming apparatus varies depending on environmental conditions at a place where the image forming apparatus is installed. Therefore, in a low temperature environment having a temperature lower than a normal temperature, if a temperature of the photoconductor drum or the intermediate transfer body increases, the temperature in the image forming device does not increase easily.

The comparative image forming apparatus controls the speed of rotation of the cooling fan irrespective of the environmental conditions of the installation place, the comparative image forming apparatus cannot enhance an energy saving and a noise reduction.

Now, a description is given of effects of the image forming apparatus 1 according to the present example of this disclosure.

In the present example of this disclosure, the controller 81 of the image forming apparatus 1 controls the driving of the driver 82 and the driving of the cooling fan 10 based on detection results obtained by the temperature sensor 5 and the counter value C. By so doing, the image forming apparatus 1 according to the present example can be prevented from toner adhesion caused by an increase of temperature and, at the same time, can contribute to energy saving and enhance a reduction in noise when compared with the comparative image forming apparatus. Further, when the detection results obtained by the temperature sensor 5 is in a medium/low temperature environment, the driver 82 is driven at the regular speed irrespective of the value of the counter value C, so that the printing efficiency can be enhanced.

By contrast, when the detection results obtained by the temperature sensor 5 is in a high temperature environment and the counter value C is greater than the first counter threshold C, the controller 81 controls the driver 82 either to interrupt the printing operation or to reduce the printing speed, so that toner adhesion caused by an increase of temperature in the developing device can be prevented.

When the print job is performed in the high temperature environment and the counter value C is greater than the first counter threshold C1, the controller 81 controls the driver 82 either to interrupt the printing operation or to reduce the printing speed. Then, after a given time has elapsed, the controller 81 controls the driver 82 to perform the printing operation at the regular speed of operation. By so doing, toner adhesion caused by an increase of temperature in the developing device can be prevented and, at the same time, can enhance the printing efficiency.

Further, when the print job is performed in the medium/low temperature environment and the counter value C is smaller than the second counter threshold C2, the controller 81 controls the driving speed of the cooling fan 10 either to reduce the driving speed thereof lower than the regular speed or to interrupt the rotation of the cooling fan 10. Consequently, the reduction in noise of the image forming apparatus 1 can be enhanced. Further, since the image forming apparatus 1 according to the present example of this disclosure does not include a thermistor to measure the temperature of the image forming device 27, a simple configuration can be achieved.

Further, when the print job is performed in the medium/low temperature environment and the counter value C becomes the third counter threshold C3 the counter value C is set to the third counter threshold C3. By so doing, the controller 81 does not cause the driver 82 either to interrupt the printing operation or to reduce the printing speed, thereby enhancing the printing efficiency.

In an image forming apparatus such as a monochrome printer, an image formed on a photoconductor is transferred onto a recording medium directly. When the duplex printing mode is selected in the monochrome printer, the recording medium passes through a fixing device when printing the image on a first side (a front side) of the recording medium and then contacts the photoconductor directly to receive an image for a second side (a rear side) thereof. Consequently, compared with the duplex printing mode, an increase in temperature of a developing device is restrained in the single sided printing mode.

When the image forming apparatus 1 according to the present example is in the single sided printing mode and the high temperature environment, the controller 81 controls the driver 82 and the cooling fan 10 to be performed at the regular speed of rotation, thereby enhancing the printing efficiency.

By contrast, when the image forming apparatus 1 according to the present example is in the single sided printing mode and in the medium/low temperature environment and the counter value C is smaller than the second counter threshold C2, the controller 81 controls the cooling fan 10 either to reduce the driving speed thereof lower than the regular speed or to interrupt the rotation of the cooling fan 10. Consequently, the reduction in noise of the image forming apparatus 1 can be enhanced.

Further, when the image forming apparatus 1 according to the present example is in the single sided printing mode and the counter value C becomes the third counter threshold C3, the counter value C is set to the third counter threshold C3. However, the controller 81 does not cause the driver 82 either to interrupt the printing operation or reduce the printing speed, and therefore the printing efficiency can be enhanced.

By monitoring the detection results obtained by the temperature sensor 5 occasionally, the controller 81 can control the driving of the driver 82 and the driving of the cooling fan 10 according to the temperature of which the apparatus body 3 is disposed. Therefore, the image forming apparatus 1 according to the present example can be prevented from toner adhesion caused by an increase of temperature and, at the same time, can contribute to energy saving and enhance a reduction in noise.

It is to be noted that, in the present example, the controller 81 controls the driver 82 and/or the cooling fan 10 based on that whether or not the image forming apparatus 1 is in the high temperature environment, which is not limited thereto. For example, the controller 81 may control the driver 82 and/or the cooling fan 10 based on whether or not the image forming apparatus 1 is in the low temperature environment that is lower than a normal temperature.

Further, it is to be noted that, in the present example, the controller 81 controls the cooling fan 10 by either one of driving at the regular speed thereof, reducing the driving speed lower than the regular speed thereof, and interrupting the driving thereof. However, this disclosure is not limited thereto. For example, the controller 81 may control the cooling fan 10, based on the detection results obtained by the temperature sensor 5 and the counter value C, by either one of driving at the regular speed, driving at a speed that is higher than the regular speed, driving at a speed that is lower than the regular speed, and interrupting the rotation thereof.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. An image forming apparatus, comprising:

a housing;

an image forming device in the housing, the image forming device configured to form an image on a recording medium;

a cooler configured to cool the image forming device;

a temperature detector configured to detect a temperature around the housing; and a controller including a memory, the controller configured to, generate a counter value during a driving period of the image forming device, the memory configured to store the counter value, drive the cooler based on the detected temperature such that the controller is configured to (i) drive the cooler independent of the counter value when the detected temperature is greater than a reference temperature, and (ii) drive the cooler dependent on the counter value when the detected temperature is lower than the reference temperature, and control driving the image forming device independent of the counter value to a driving speed when the detected temperature is lower than the reference temperature.

2. The image forming apparatus according to claim 1, wherein the controller is further configured to, compare the counter value and a first counter threshold value, and stop the driving of the image forming device if-when (i) the detected temperature is greater than the reference temperature, and (ii) the counter value is greater than the first counter threshold value.

3. The image forming apparatus according to claim 1, wherein the controller is further configured to, compare the counter value and a first counter threshold value, stop the driving of the image forming device when (i) the detected temperature is greater than the reference temperature, and (ii) the counter value is greater than the first counter threshold value, and adjust the driving speed of the image forming device when the driving speed of the image forming device becomes lower than a speed threshold and when a first time period has elapsed.

4. The image forming apparatus according to claim 1, wherein the controller is further configured to, compare the counter value and a first counter threshold value, and reduce a driving speed of the cooler when (i) the detected temperature is lower than the reference temperature, and (ii) the counter value is smaller than the first counter threshold value.

5. The image forming apparatus according to claim 4, wherein the controller is further configured to, compare the counter value and a third counter threshold value, the third counter threshold value is smaller than a second counter threshold value and greater than the first counter threshold value, and store the third counter threshold value to the memory when (i) the detected temperature is lower than the reference temperature, and (ii) the counter value is equal to the third counter threshold value.

6. The image forming apparatus according to claim 1, wherein the controller is further configured to, control at least one of the driving of the image forming device and the driving of the cooler in a duplex printing mode, the duplex printing mode includes forming the image on a first side and a second side of the recording medium.

7. The image forming apparatus according to claim 1, wherein the controller is further configured to, compare the counter value and a first counter threshold value in a single side printing mode, the single side printing mode includes forming the image on a first side of the recording medium, and reduce a driving speed of the cooler when (i) the detected temperature is lower than the reference temperature, and (ii) the counter value is smaller than the first counter threshold value.

8. The image forming apparatus according to claim 7, wherein the controller is further configured to, compare the counter value and a third counter threshold value, the third counter threshold value is smaller than a second counter threshold value and greater than the first counter threshold value, and store the third counter threshold value in the memory, when (i) the detected temperature is greater than the reference temperature, and (ii) the counter value is equal to the third counter threshold value.

9. The image forming apparatus according to claim 7, wherein the controller is further configured to, compare the counter value and a third counter threshold value, the third counter threshold value is smaller than a second counter threshold value and greater than the first counter threshold value, and store the third counter threshold value in the memory, when (i) the detected temperature is less than the reference temperature, and (ii) the counter value is equal to the third counter threshold value.

10. The imaging forming apparatus of claim 1, wherein the counter value includes a number of counts, the number of counts corresponds to a value which is incremented and decremented based on a speed of a driver in the image forming device.

11. The image forming apparatus of claim 10, wherein the controller is further configured to decrement the number of counts when the controller stops the driver.

12. The image forming apparatus of claim 10, wherein the controller is further configured to, reduce a driving speed of the cooler if (i) the detected temperature is less than the reference temperature, and (ii) the counter value is less than a first counter threshold value.

13. The image forming apparatus of claim 12, wherein the first counter threshold value corresponds to a surface temperature of a photoconductor drum.

14. The image forming apparatus of claim 10, wherein the controller is further configured to, control at least one of the driving of the image forming device and the driving of the cooler in at least one of a duplex printing mode and a single printing mode, the duplex printing mode includes forming an image on a first side and a second side of a recording medium, and the single side printing mode includes forming the image on the first side of the recording medium.

15. The imaging forming apparatus of claim 1, wherein the controller is further configured to, control the driving of the image forming device at the driving speed until the counter value equals a threshold value when the detected temperature is higher than the reference temperature.

16. The image forming apparatus of claim 15, wherein the controller is further configured to, reduce the driving speed of the image forming device when the counter value equals the threshold value, and maintain a driving speed of the cooler when the controller reduces the driving speed of the image forming device.

17. The image forming apparatus of claim 16, wherein the controller is further configured to reduce the driving speed of the image forming device for a time period corresponding to a time period for reducing a temperature of a photoconductor drum.

18. The image forming apparatus of claim 15, wherein the controller is further configured to decrement a number of counts when the controller stops the driver.

19. The image forming apparatus of claim 15, wherein the controller is further configured to, control at least one of the driving of the image forming device and the driving of the cooler in at least one of a duplex printing mode and a single printing mode, the duplex printing mode includes forming an image on a first side and a second side of a recording medium, and the single side printing mode includes forming the image on the first side of the recording medium.

* * * * *